United States Patent [19]

Eppler

[11] 3,930,393

[45] Jan. 6, 1976

[54] DIE ASSEMBLY

[75] Inventor: Daniel Eppler, Old Bridge, N.J.

[73] Assignee: Thomas & Betts Corporation, Elizabeth, N.J.

[22] Filed: Mar. 13, 1975

[21] Appl. No.: 558,166

[52] U.S. Cl. ..... 72/133; 72/410; 29/203 DT

[51] Int. Cl.[2] ..... H01R 5/10

[58] Field of Search ..... 72/133, 410, 418; 140/111, 140/113; 29/203 D, 203 DT, 203 DTS, 203 H, 280, 282

[56] References Cited

UNITED STATES PATENTS

| | | | |
|---|---|---|---|
| 3,434,511 | 3/1969 | Mixon, Jr. | 140/111 |
| 3,636,612 | 1/1972 | Suprun | 29/203 |
| 3,667,102 | 6/1972 | Guillemette et al. | 29/203 |

*Primary Examiner*—Lowell A. Larson
*Attorney, Agent, or Firm*—David Teschner; Jesse Woldman

[57] ABSTRACT

A pair of cooperating die members are disposed in a housing and arranged to slidably move along respective intersecting axes so that a forming portion of one of the die members is caused to progressively approach the nest portion of the other die member along an incline terminating at the nose portion of the housing, the nest portion of the one die member being arranged to support a preferably U-shaped deformable terminal, the arms of which are then caused to be contacted by the forming portion of the other die member and longitudinally progressively folded inwardly against one or more articles located within the terminal.

16 Claims, 20 Drawing Figures

DIE ASSEMBLY

BACKGROUND OF THE INVENTION

1. Field of the Invention

The invention is directed to the field of tools for metal forming and the like.

2. Description of the Prior Art

In the field of die assemblies adapted for use in crimping or otherwise deforming metallic terminals for joining or splicing articles to one another, two principle modes of operation are generally utilized. The more conventional devices generally comprise a pair of mating die members movable towards one another along a common axis to provide a given compressive force to a deformable terminal or like element seated therebetween. Proliferous examples of such die assemblies may be found in the prior art and are sufficiently well known to those skilled in the art. The other mode of operation utilizes longitudinal displacement of the connector through a restrictive orifice to extrudably deform the terminal or connector about one or more contained wires or conductors. An example of such device is disclosed in U.S. Pat. No. 3,739,470 issued June 19, 1973 to applicant and assigned to the assignee of the instant invention. In the latter method, the terminal must be fabricated from special material which must be extrudably deformable without fracture or damage occurring thereto in order to preserve the integrity of the connection. Furthermore, by virtue of the extrusion process, both the terminal and enclosed wires are elongated and reduced in cross-section to a significant degree upon completion of the operation, a condition which may be undesirable in many applications where the cross-sectional area of the completed joint or connection is of principle importance. The former conventional method of direct crimping, although used quite successfully in many applications, has the distinct drawback of requiring relatively high crimping forces when employed with the larger size conductors and associated terminals, thereby requiring the use of relatively bulky and expensive drive sources for use therewith. In many cases where such connections must be made in remote locations removed from a worksite, convenience of portability may become a major factor in the use thereof, whereby the weight and size of such prior art devices may seriously limit their applicability under such conditions.

SUMMARY OF THE INVENTION

The invention overcomes the limitations and difficulties noted above with respect to such prior art devices by providing a terminal folding die assembly which is lighter, more versatile, more convenient, and requires substantially less driving force than such prior art devices. The die assembly comprises a pair of die members slidably mounted in a housing and independently movable along respective axes which intersect one another generally adjacent the front or nose portion of the housing. One die member includes a terminal receiving nest and the other die member is provided with a terminal-forming or folding portion, the latter die member being slidably movable along an axis inclined at an oblique angle to the axis of the nest-bearing die member. Each of the die members is guided along an appropriately formed channel within the housing to insure accurate movement thereof. In one embodiment, the nest of the nest-bearing die member is positionable forwardly of the housing for loading of a connector or terminal therein, while an alternative arrangement utilizes a transverse aperture in the housing for a similar purpose. The conductors or other articles to be joined to one another may be placed into the terminal either from the front or nose portion of the housing or through the aforementioned transverse aperture. The terminal forming or folding portion of the associated die member may be pivotingly or otherwise movably connected to the remainder of the die member to permit it to be manipulated to an open position and the housing suitably selectively slotted along its length to permit midspan engagement of a continuous length of wire where it is desired, for example, to provide a tapped joint thereat. In operation, both die members are initially retracted to a first postion remote from the nose portion of the housing, so that access may be had to the terminal-receiving nest of the nest bearing die member. As an alternative, the nest-bearing die member may be advanced, as described above, to expose the nest for loading and then returned to its retracted position. The forming or folding die member is then advanced along its guide rails to a second position generally adjacent the front or nose portion of the housing, the exact position thereof being controlled by adjusting means thereon cooperable with the housing. Since this die member is guided along an axis oblique to the axis of movement of the other die member, the forming or folding portion thereof will be disposed at an oblique angle to the other die member and in generally wedging relationship to the terminal seated therein. The other die member is then driven forwardly towards the nose portion of the housing, causing the terminal seated therewithin to be progressively wedged between the two die members so that successive portions of the upstanding legs of the terminal are progressively folded inwardly and downwardly against the contained articles as the nest-bearing die member is progressively advanced along its axis of movement. The amount of force required to fully fold or deform the terminal arms will be directly proportional to the angular displacement between the two die members, a smaller angle resulting in a decrease of operating force, and a larger angle resulting in a commensurate increase in operating force, but, in either case, resulting in a required operating force significantly less than the required to accomplish deformation of the terminal by the more conventional means of uniaxial compression. It is therefore an object of this invention to provide a novel die assembly.

It is another object of this invention to provide a die assembly arranged to significantly reduce the force required to mechanically deform a terminal or connector.

It is a further object of this invention to provide a multiaxial die assembly.

It is yet another object of this invention to provide a means for progressively folding a terminal along its length about one or more articles located therewithin.

It is still a further object of this invention to provide a means for splicing two or more conductors with a minimum of operating force.

It is still another object of this invention to provide means for wedgingly deforming a terminal.

It is still a further object of this invention to provide a die assembly in which the die members thereof are slidably moveable along respective angularly displaced axes.

It is yet another object of this invention to provide a die assembly in which the work required to deform a terminal is divided generally equally along the length of the terminal.

It is still a further object of this invention to provide a means for deforming a terminal about one or more contained wires or articles in such manner as to significantly reduce the spring-back characteristics thereof.

Other objects and features will be pointed out in the following description and claims and illustrated in the accompanying drawings which disclose, by way of example, the principle of the invention and the best mode contemplated for carrying it out.

BRIEF DESCRIPTION OF THE DRAWINGS

In the Drawings.

Similar elements are given similar reference characters in each of the respective drawings.

DESCRIPTION OF THE PREFERRED EMBODIMENT

Figure 2:
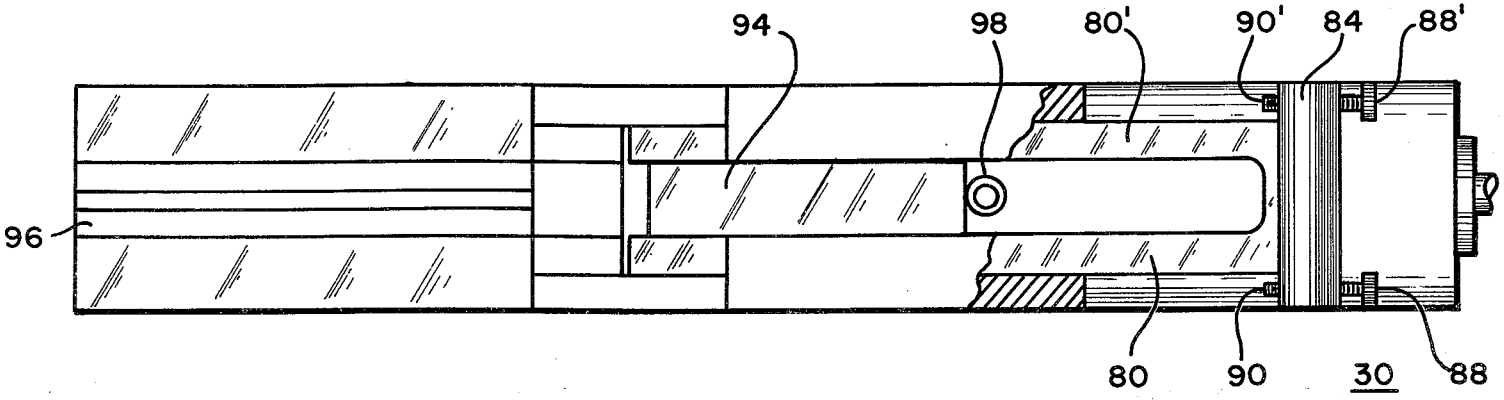
FIG. 2 is a top plan view, partly in section and partly cut away, of the die assembly of FIG. 1.
Figure 1:
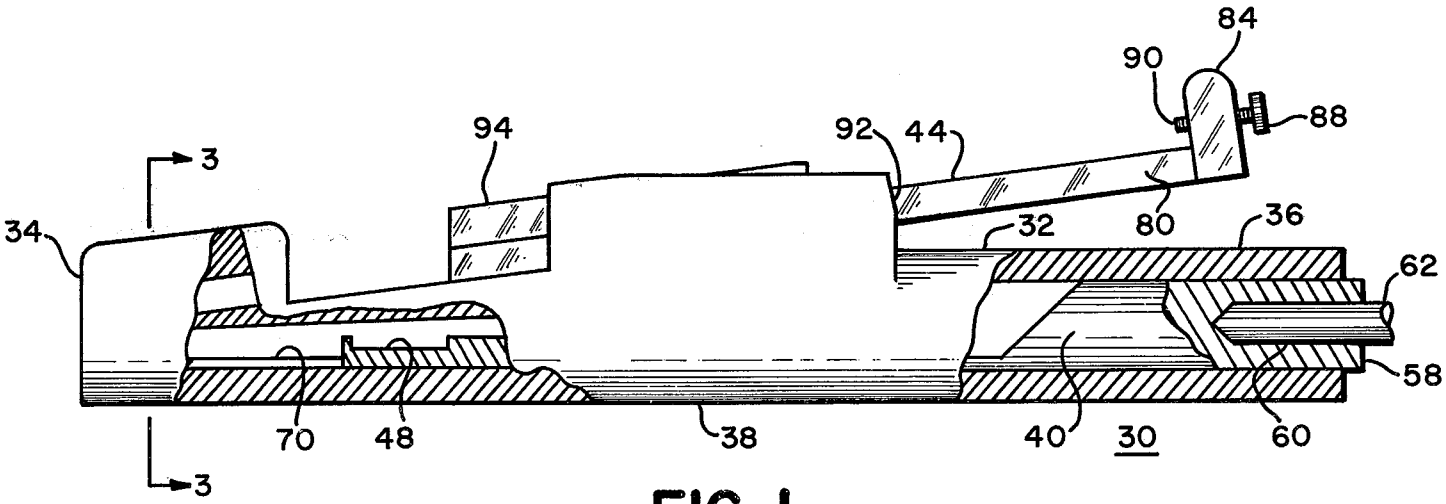
FIG. 1 is a side elevational view, partly in section and partly cut away, of a die assembly constructed in accordance with the concepts of the invention.
Figure 3:
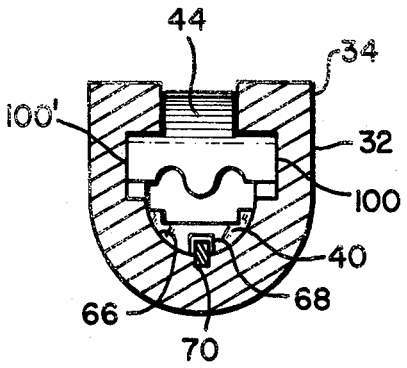
FIG. 3 is a front elevational view, in section, taken along the line 3—3 of FIG. 1.
Figure 4:
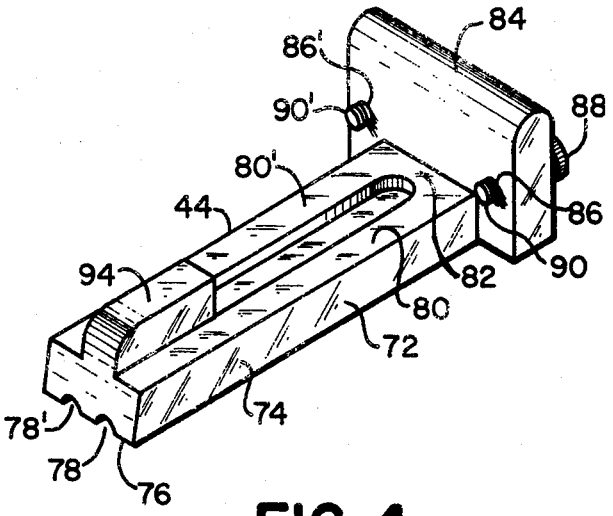
FIG. 4 is a perspective view of one of the die members of the device of FIG. 1.
Figure 5:
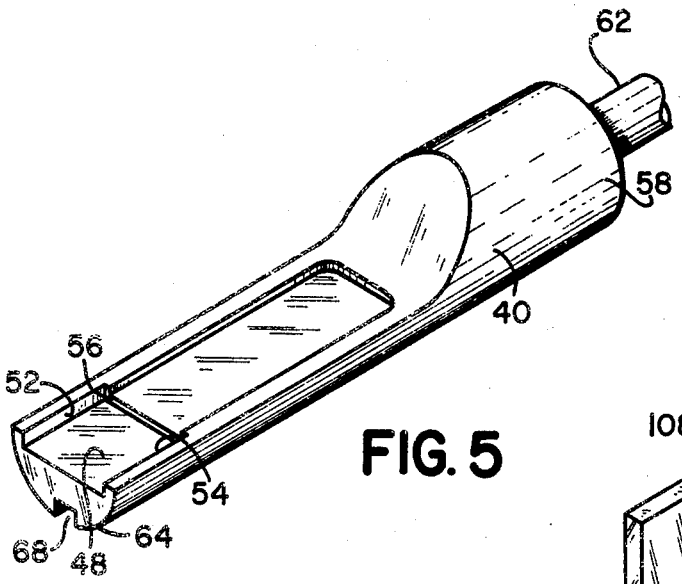
FIG. 5 is a perspective view of the other die member of the device of FIG. 1.
Figure 6:
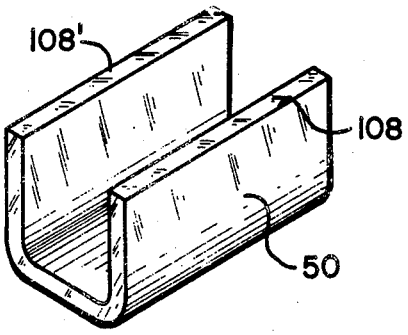
FIG. 6 is a perspective view of a terminal configuration suitable for use with the die assembly of FIG. 1.
Figure 8:
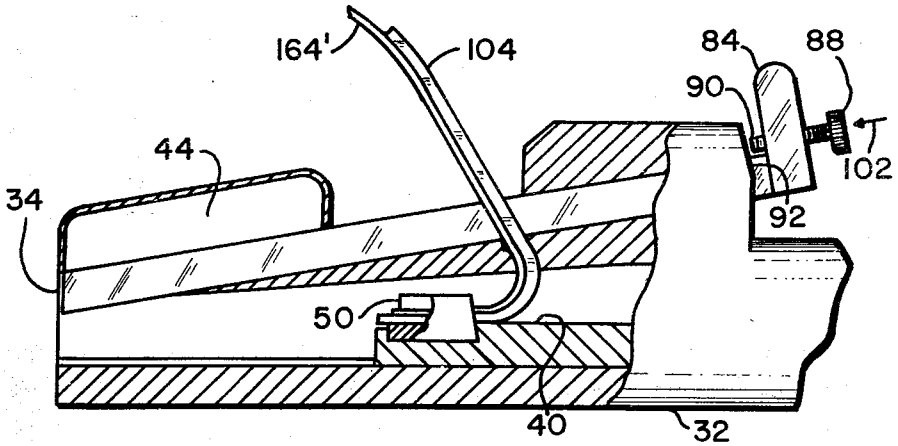
FIG. 8 is a fragmentary side elevational view, partly cut away and partly in section, of a portion of the die assembly of FIG. 1 showing the die members in a partially advanced state of operation.
Figure 10:
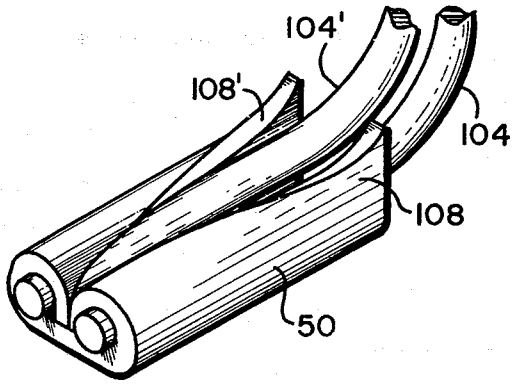
FIG. 10 is a perspective view of the terminal of FIG. 6 in a partial state of deformation.
Figure 7:
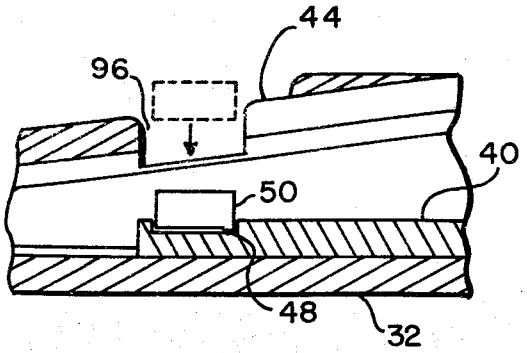
FIG. 7 is a fragmentary side elevational view, partly in section, of a portion of the die set of FIG. 1, showing a manner of loading a terminal thereinto.
Figure 9:
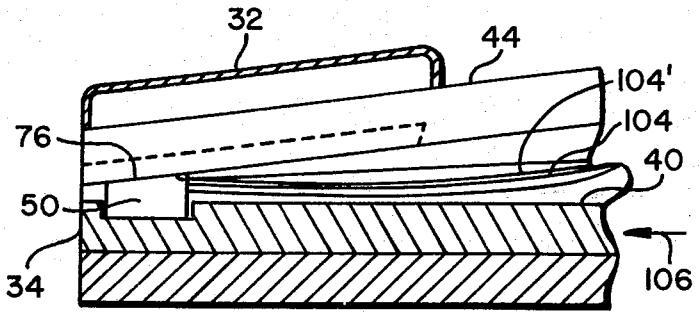
FIG. 9 is a fragmentary side elevational view, partly in section, of a portion of the die assembly of FIG. 1 showing the die members in a more fully advanced state of operation.
Figure 11:
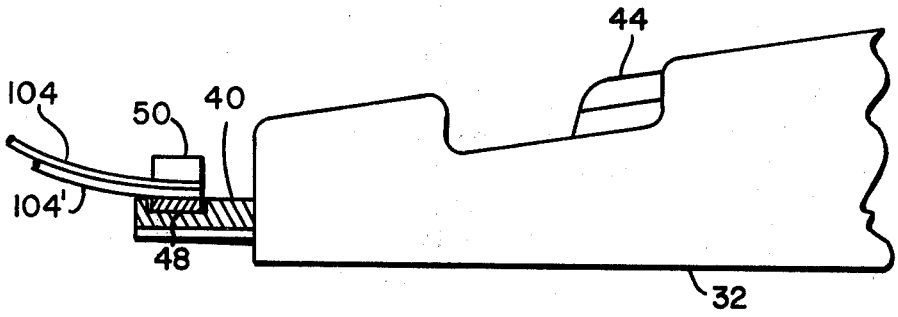
FIG. 11 is a fragmentary side elevational view, partly in section, of the device of FIG. 1 showing an alternative arrangement for loading.
Figure 12:
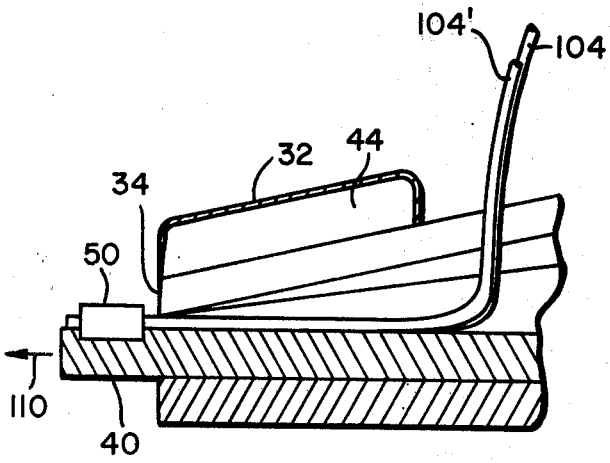
FIG. 12 is a fragmentary side elevational view, partly in section, of a portion of the device of FIG. 1, showing the die members in a fully advanced state of operation.
Figure 13:
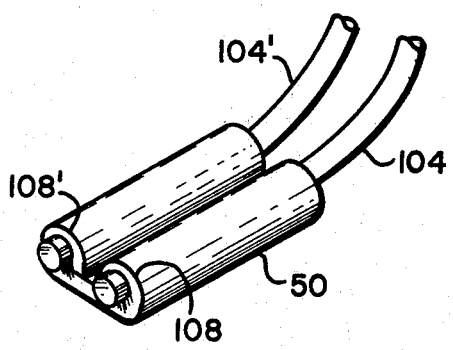
FIG. 13 is a perspective view of the terminal of FIG. 6 after completion of the deforming operation.
Figure 19:
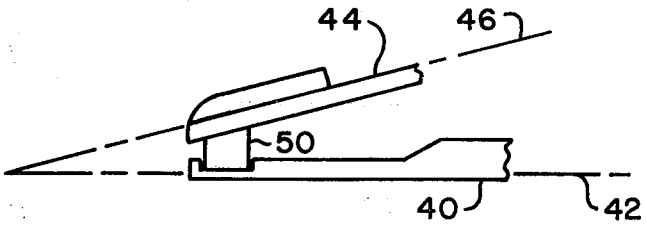
FIGS. 17, 18, 19, and 20 are diagrammatic views of the device of FIG. 1, illustrating the relative axial movement of the die members thereof during the operating cycle.
Figure 20:
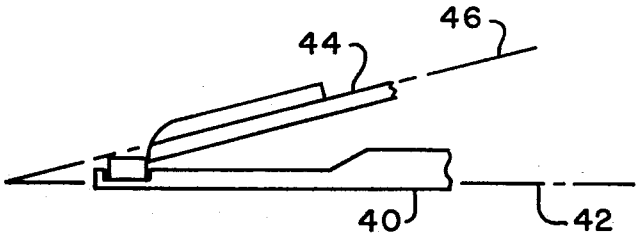
Figure 17:
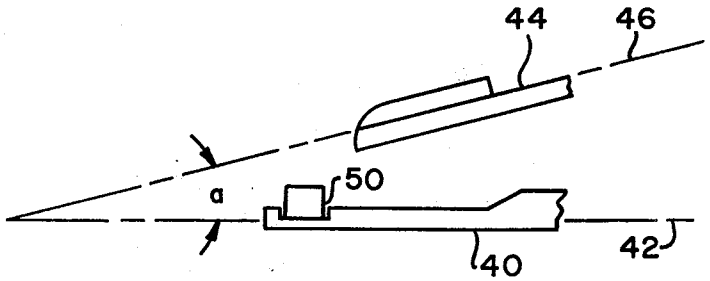
Figure 18:
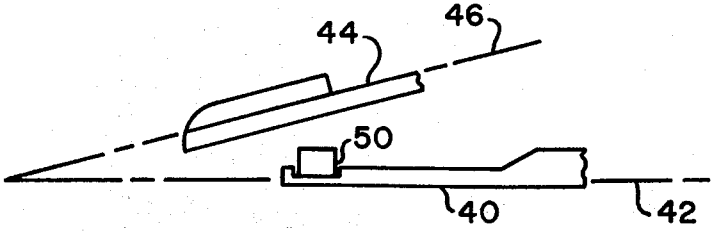

Turning now to FIGS. 1 through 13, and 17 through 20, there is shown a die assembly 30 constructed in accordance with the concepts of the invention and comprising a housing 32 having a first end 34 defining a nose portion thereof, a second end 36 defining the rear of the housing 32, and a central portion 38 intermediate the first and second ends 34 and 36 respectively. The housing 32 is formed preferably as a tubular structure and houses a first die member 40 slidably mounted in the housing 32 and movable along a first axis 42 (FIG. 17) generally parallel to the longitudinal axis of the housing 32. The housing 32 also contains a second die member 44 similarly slidably mounted therein and movable along a second axis 46 (FIG. 17) inclined to the first axis 42 at angle *a* and selectively arranged to intersect the first axis 42 generally adjacent the first end 34 of the housing 32. The first die member 40 further includes a nest portion 48 adjacent its forward end and arranged to provide a seat for a terminal 50 (FIG. 6) in the manner shown in FIG. 7. The nest portion 48 is formed as a recessed portion in the first die member 40 and includes sidewalls 52, 54, and 56 (FIG. 5) arranged to conform generally to the dimensions of the base of the terminal 50 so that the terminal 50 may be accurately located therewithin for subsequent deformation. The first die member 40 further comprises a rear portion 58 having a piston-like configuration and including a bore 60 suitably dimensioned to tightly fit about an extension 62 partially shown in FIGS. 1 and 5. The extension 62 is arranged to be coupled to a convenient electric, hydraulic, pneumatic or manual driving source (not shown) which may be attached to the second end 36 of the housing 32 in any convenient manner to provide an integral unit including both the driving source and the die set 30. The first die member 40 may thus be slidably driven forwardly and rearwardly along its axis 42 within the housing 32. As shown in further detail in FIGS. 3 and 5, the first die member 40 has a generally semi-cylindrical configuration in cross section along a substantial portion of its length thereby providing an arcuate outer surface 64 proportioned to slidingly mate with an adjacent inner surface 66 within the housing 32. The first die member 40 further includes a longitudinally extending slot 68 engageable with a key 70 centrally located within the surface 66 of the housing 32 to prevent axial rotation of the first die member 40 within the housing. As shown in further detail in FIG. 4, the second die member 44 comprises an elongate body 72 having a first or forward end 74 including a forming portion 76 suitably shaped to impart a folding action to a terminal such as 50 in a manner to be described in greater detail hereafter. In the particular embodiment illustrated in FIG. 4, the forming portion 76 comprises a pair of juxtaposed arcuate grooves or recesses 78, 78′ extending lengthwise within the forming portion 76. It should be noted, however, that the forming portion 76 may be suitably modified to provide other forming shapes commensurate with the particular terminal being employed and the desired final shape of the deformed terminal. Extending rearwardly from the forming portion 76 is a pair of spaced ribs 80, 80′ joined together at their distal ends by an interconnecting portion 82. To facilitate manual manipulation of the second die member 44, there is provided a handle member 84 having a pair of threaded transverse apertures 86, 86' engaging the shanks of a pair of respective threaded adjusting means such as members 88, 88' (FIG. 2). By suitable adjustment thereof the members 88, 88' provide a means for controlling the maximum forward displacement of the second die member 44 in the housing 32. This is accomplished by rotating each of the members 88, 88' either clockwise or counterclockwise so that the ends of the shanks thereof, indicated by the numerals 90, 90' in FIG. 2, extend beyond the adjacent face of the handle 84 a given distance whereby, upon the advance of the second die member 44 forwardly towards the first end 34 of the housing 32, the ends 90 and 90' are caused to contact a surface 92 (FIG. 8) of the housing 32 at a given position, thereby controlling the distance between the forming portion 76 of the second die member 44 and the nest portion 48 of the first die member 40 during the operating cycle and, accordingly, controlling the degree of fold of the terminal 50 in a manner to be described more fully below. The second die member 44 further comprises a stepped portion 94 slidable within a longitudinally extending slot 96 in the housing 32, the slot 96 providing an opening from the exterior to the interior of the housing 32. The rearward travel of the second die member 44 is restricted by a stop means such as a threaded member 98 (FIG. 2) fastened to the housing 32 and arranged to abut an adjacent surface of the second die member stepped portion 94 as the second die member 44 is retracted to the position shown generally in FIG. 2. As shown in further detail in FIG. 3, the housing 32 further comprises a pair of opposing interior tracks or channels 100, 100' oriented oblique to the longitudinal axis of the housing 32 and generally parallel to the second axis 46. The ribs 80 and 80' of the second die member 44 are arranged to slide within the respective channels 100, 100' which thus guide and control the path of the second die member 44 coincident with the second axis 46. As shown in FIG. 7, the terminal 50 is loaded into the first die member nest portion 48 through the opening 96 in the housing 32 as the second die member 44 is positioned in its retracted position. Thereafter, the second die member 44 is advanced forwardly towards the first end 34 of the housing 32 in the direction indicated by the arrow 104 in FIG. 8. The opening between the ribs 80, 80' of the second die member 44 is now positioned over the nest portion 48 of the first die member 40 permitting the insertion of one or more articles such as conductors 104, 104' into the interior of the housing 32 for placement into the terminal 50 substantially as shown in FIG. 8. In an alternative mode of loading, the first die member 40 may be advanced forwardly of the first end 34 of the housing 32 as shown in FIG. 11 so as to expose the nest portion 48 which may then be loaded with the terminal 50 and the wires 104, 104', substantially as shown, after which the first die member is retracted to the position shown in FIG. 8 and the second die member 44 advanced forwardly, as described above. The first die member 40 is then driven forwardly towards the first end 34 of the housing 32 in the direction shown by the arrow 106 in FIG. 9. As the terminal 50 which comprises a pair of upstanding arms 108, 108' approaches the forming portion 76 of the second die member 44, the leading edges of the arms 108, 108' are caused to contact the grooves 78, 78' and are accordingly progressively curled or folded inwardly. FIG. 10 illustrates generally the terminal 50 as it appears after having undergone a partial curl of the arms 108, 108' during an intermediate portion of the folding operation, i.e., where the terminal 50 has not yet been fully advanced beyond the contacting surface of the forming portion 76 of the second die member 44. The final stage of the folding operation is shown in FIG. 12 wherein the first die member 40 has been advanced sufficiently in the direction indicated by the arrow 110 to cause the terminal 50 to completely traverse the forming portion 76 of the second die member 44, resulting in the completed connection shown generally in FIG. 13 wherein the entire length of the arms 108, 108' have been folded or curled against the wires 104, 104'. It will be appreciated that the above described progressive incremental folding or curling operation requires substantially less force to accomplish than would be the case where the arms 108, 108' were folded downwardly simultaneously along their entire length, since, in the instant case, only a relatively short segment of each arm is subjected to the folding force at any one instant of time. A diagrammatic representation of the sequence of operation and the associated axial movement of each of the die members 40 and 44 is illustrated in FIGS. 17 through 20, wherein FIG. 17 illustrates the initial position of the die members 40 and 44 along their respective axis during the terminal loading stage; FIG. 18 illustrates the relative movement of the second die member 44 for positioning adjacent the first end 34 of the housing 32; FIG. 19 illustrates the relative movement of the first die member 40 during an intermediate folding stage; and FIG. 20 illustrates the relative positions of the die members 40 and 44 at the final stage of operation. Removal of the completed connection including the folded terminal 50 and wires 104, 104' is accomplished simply by retracting the first die member 40 into the housing 32 sufficiently to allow the terminal 50 to clear the forming portion 76 of the second die member 44 and be lifted out of the nest portion 48 of the first die member 40 and through the opening 96 in the housing 32. In the arrangement shown in FIG. 11, however, the retracting step is eliminated since the completed connection may be immediately lifted out of the first die member nest portion 48 upon completion of the forward stroke of the first die member 40.

Figure 14:
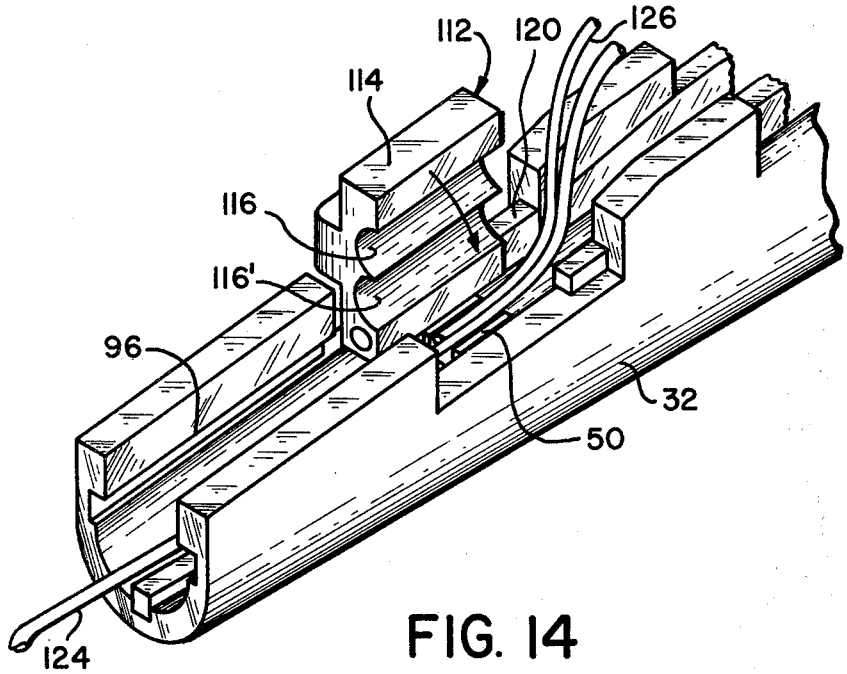
FIG. 14 is a fragmentary perspective view of a further embodiment of a die assembly constructed in accordance with the concepts of the invention.
Figure 15:
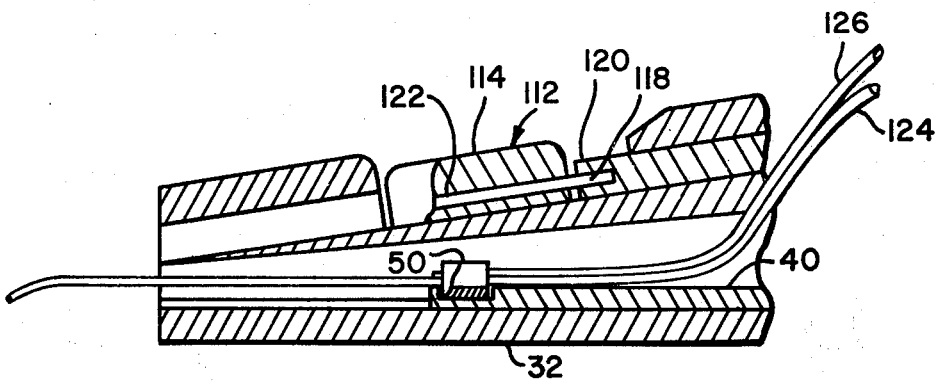
FIG. 15 is a fragmentary side elevational view, in section, of a portion of the device of FIG. 14.
Figure 16:
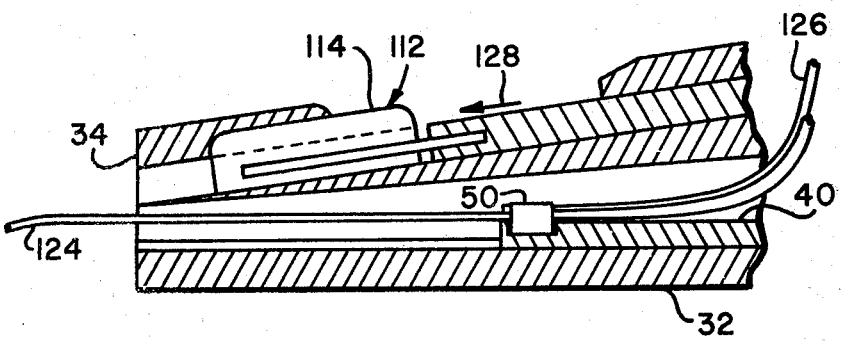
FIG. 16 is a fragmentary side elevational view, in section, of a portion of the device of FIG. 14 in a partially advanced state of operation.

Turning now to FIGS. 14, 15, and 16 there is shown a further embodiment of a second die member 112 constructed in accordance with the concepts of the invention and arranged to permit the advantageous use thereof to effect a midspan splice or tap connection at any given location along a continuous wire or conductor. The second die member 112 comprises a forming portion 114 essentially similar to the forming portion 76 of the second die member 44 and includes longitudinally extending grooves 116, 116' essentially duplicative of the grooves 78, 78' shown in FIG. 4. The forming portion 114, however, is separable from the remainder of the die member 112 and is rotatable about a pin 118 (FIG. 15) extending from a first rib 120 of the second die member 112 into a longitudinal mating bore 122 in the forming portion 114. Thus, as shown in FIG. 14, the forming portion 114 may be rotatably displaced away from the housing opening 96 to provide full access to the interior of the housing 32 along the entire length of the opening 96. Thus, to effect a mid span splice or tap, the operator simply rotates the forming portion 114 away from the housing 32 to the position shown in FIG. 14 and inserts the desired portion of a continous conductor or wire such as 124 through the opening 96 and into the terminal 50 seated in the nest portion 48 of the first die member 40. A second conductor or wire 126 may then be inserted into the housing 32 for placement into the terminal 50 at the desired tap or splice location. The forming portion 114 is then rotated back into coincidence with the remainder of the second die member 112, as shown in FIG. 15. The second die member 112 is then advanced forwardly towards the first end 34 of the housing 32 in the direction indicated by the arrow 128, essentially as described above with respect to the embodiment illustrated in FIG. 1. The remainder of the folding sequence similarly follows that described heretofore, and, upon completion of the connection, the first die member 40 is retracted to permit removal of the completed assembly including the terminal 50 and the tap or splice connection formed thereby. It should, of course, be readily appreciated that the particular configuration of the forming portion 76 described and illustrated herein may be modified in the usual manner to impart a variety of folding or curling configurations commensurate with the particular terminal being employed. Similarly, the first die member nest portion 48, shown as an essentially rectangular recess, may be modified to coincide with differing terminal bore configurations according to a particular application and within the concepts herein disclosed.

The embodiments of the invention in which an exclusive property or privilege is claimed are defined as follows:

1. A die assembly for joining articles comprising: an elongate housing having a first end and second end; a first die member slidable in said housing along a first axis towards and away from said housing first end; a second die member slidable in said housing along a second axis towards and away from said housing first end; said second axis being selectively disposed at an oblique angle to said first axis and intersecting said first axis generally adjacent said first end of said housing; said first die member having a nest portion for receiving a terminal therein for movement towards said first end of said housing; said second die member having a forming portion generally facing said first die member nest portion and arranged to selectively progressively approach said first die member nest portion upon movement of said first and said second die members towards said housing first end, wherein upon the insertion of a deformable terminal within said first die member nest portion and the movement of said first and said second die members towards said housing first end, said second die member forming portion is caused to progressively approach said first die member nest portion and progressively wedgingly deform such terminal about such articles located therewithin.

2. A die assembly as defined in claim 1 wherein said second die member forming portion comprises elongate grooved portions arranged in juxtaposed relationship.

3. A die assembly as defined in claim 1 wherein said housing comprises key means cooperative with said first die member to maintain said first die member in a given orientation with respect to said second die member.

4. A die assembly as defined in claim 1 wherein said housing comprises guide means cooperative with said second die member to maintain said second die member in a given orientation with respect to said first die member.

5. A die assembly as defined in claim 1 wherein said housing has a transverse opening communicating with said first die member nest portion to provide access thereto.

6. A die assembly as defined in claim 1 wherein said second die member further comprises adjustable means cooperative with said housing for selectively controlling the stroke of said second die member.

7. A die assembly as defined in claim 6 wherein said adjustable means comprises a threaded member attached to said second die member for selective contacting engagement with said housing.

8. A die assembly as defined in claim 1 wherein said first die member further comprises means engageable with an external driving member for forcibly advancing said first die member towards said housing first end.

9. A die assembly as defined in claim 8 wherein said means comprises an extension affixed to said first die member remote from said first die member nest portion and protruding beyond said housing second end.

10. A die assembly as defined in claim 1 wherein said housing has a transverse opening communicating with said first die member nest portion and said second die member forming portion is displaceable towards and away from said transverse opening as said second die member is positioned remote from said housing first end.

11. A die assembly as defined in claim 10 wherein said second die member forming portion is pivotingly displaceable towards and away from said transverse opening.

12. A die assembly as defined in claim 1 wherein said first die member nest portion is positionable forwardly of said housing first end.

13. A die assembly as defined in claim 1 wherein said first axis extends generally parallel to the longitudinal axis of said housing.

14. A die assembly as defined in claim 13 wherein said second axis extends generally oblique to the longitudinal axis of said housing.

15. A die assembly as defined in claim 1 wherein said housing has a generally tubular configuration, there being an elongate opening extending longitudinally from said housing first end towards said housing second end, said second die member further comprising a stepped portion slidable within said housing elongate opening.

16. A die assembly as defined in claim 15 further comprising means on said housing for limiting the movement of said second slide member where said second slide member is moved towards said housing second end.

* * * * *